US006375690B1

(12) United States Patent
Gunnink et al.

(10) Patent No.: US 6,375,690 B1
(45) Date of Patent: Apr. 23, 2002

(54) PROCESS FOR FORMING COAL COMPACTS AND PRODUCT THEREOF

(75) Inventors: Brett Gunnink, Columbia, MO (US); Jayanth Kanunar, Arlington, MA (US); Zhuoxiong Liang, San Francisco, CA (US)

(73) Assignee: The Curators of the University of Missouri, Columbia, MO (US)

( * ) Notice: Subject to any disclaimer, the term of this patent is extended or adjusted under 35 U.S.C. 154(b) by 0 days.

(21) Appl. No.: 08/405,599

(22) Filed: Mar. 17, 1995

(51) Int. Cl.[7] ..... C10L 5/00
(52) U.S. Cl. ..... 44/594; 44/596; 44/597
(58) Field of Search ..... 44/535, 550, 594, 44/597, 596

(56) References Cited

U.S. PATENT DOCUMENTS

| | | | | | |
|---|---|---|---|---|---|
| 1,149,536 | A | * | 8/1915 | Phillips | 44/594 |
| 1,267,711 | A | | 5/1918 | Sutcliffe | |
| 1,597,570 | A | * | 8/1926 | Beadequin | 44/597 |
| 1,597,571 | A | * | 8/1926 | Beadequin | 44/597 |
| 2,162,064 | A | | 6/1939 | Curran | 202/9 |
| 3,752,656 | A | * | 8/1973 | Rutkowski et al. | 44/594 |
| 3,841,849 | A | * | 10/1974 | Beckmann | 44/597 |
| 4,049,392 | A | * | 9/1977 | Furman | 44/535 |
| 4,169,711 | A | | 10/1979 | Anderson | 44/26 |
| 4,179,269 | A | | 12/1979 | Yates et al. | 44/10 B |
| 4,208,188 | A | * | 6/1980 | Dick, Jr. | 44/596 |
| 4,224,039 | A | | 9/1980 | Smith et al. | 44/10 |
| 4,243,393 | A | | 1/1981 | Christian | 44/14 |
| 4,331,446 | A | | 5/1982 | Draper et al. | 44/24 |
| 4,478,601 | A | | 10/1984 | Stephens | 44/14 |
| 4,494,962 | A | | 1/1985 | Christie et al. | 44/15 |
| 4,681,597 | A | | 7/1987 | Byrne et al. | 44/15 |
| 4,702,745 | A | * | 10/1987 | Kamei et al. | 44/594 |
| 4,738,685 | A | | 4/1988 | Goleczka et al. | 44/15 B |
| 4,787,913 | A | | 11/1988 | Goleczka et al. | 44/16 R |
| 4,949,317 | A | | 8/1990 | Liu et al. | 406/46 |
| 5,067,968 | A | | 11/1991 | Davidson et al. | 44/550 |
| 5,238,629 | A | | 8/1993 | Davidson | 264/123 |

FOREIGN PATENT DOCUMENTS

| | | |
|---|---|---|
| GB | 14841 | 9/1911 |
| GB | 20679 | 1/1916 |
| GB | 616857 | 1/1949 |

OTHER PUBLICATIONS

R. J. Piersol, State of Illinois Department of Registration and Education, Division of the State Geological Survey, "Briquetting Illinois Coals Without a Binder by Competition and by Impact—A Progress Report of a Laboratory Investigation", 1933, pp. 4–70 Month unknown.

(List continued on next page.)

*Primary Examiner*—Margaret Medley
(74) *Attorney, Agent, or Firm*—Senniger, Powers, Leavitt & Roedel

(57) ABSTRACT

A process for forming durable, mechanically strong compacts from coal particulates without use of a binder is disclosed. The process involves applying a compressive stress to a particulate feed comprising substantially water-saturated coal particles while the feed is heated to a final compaction temperature in excess of about 100° C. The water present in the feed remains substantially in the liquid phase throughout the compact forming process. This is achieved by heating and compressing the particulate feed and cooling the formed compact at a pressure sufficient to prevent water present in the feed from boiling. The compacts produced by the process have a moisture content near their water saturation point. As a result, these compacts absorb little water and retain exceptional mechanical strength when immersed in high pressure water. The process can be used to form large, cylindrically-shaped compacts from coal particles (i.e., "coal logs") so that the coal can be transported in a hydraulic coal log pipeline.

20 Claims, 4 Drawing Sheets

OTHER PUBLICATIONS

H. R. Gregory, Journal of the Institute of Fuel, "A New Process for Briquetting Coal Without a Binder", Sep. 1960, pp. 447–461.

D. C. Rhys Jones, Chemistry of Coal Utilization: Supplementary Volume, Chapter 16, "Briquetting", 1963, pp. 675–753 Month unknown.

G. Ellison and B. R. Stanmore, Journal of Fuel Processing Technology, "High Strength Binderless Brown Coal Briquettes", 1981, vol. 4, pp. 277–289 and 291–304 Month unknown.

D. Makrutzki, et al., Aufbereitungs–Technik, "Continuous briquetting of hard coal without a binder", 1989, No. 7, pp. 405–412 Month unknown.

Brett Gunnink and Zhuoxiong Liang, Proceedings of the 17th International Conference on Coal Utilization and Slurry Technologies, "Compaction of Binderless Coal Logs for Coal Pipelines", 1992, pp. 677–686 Month unknown.

M. R. Miller, G. L. Fields, R. W. Fisher and T. D. Wheelock, Proceedings of the 16th Biennial Conference, IBA, "Coal Briquetting Without a Binder", pp. 325–349 Date unknown.

Brett Gunnink and Zhuoxiong Liang, Journal of Fuel Processing Technology, "Compaction of Binderless Coal for Coal Log Pipelines", 1994, vol. 37, pp. 237–254 Date unknown.

Henry Liu, et al., 19th International Technical Conference on Coal Utilization and Fuel Systems, "Coal Log Technology for Handling and Transporting Coal Fines", 1994, pp. 1–5 Month unknown.

Jayanth J. Kananur, Masters of Science Thesis, University of Missouri—Columbia, "Compaction of High Strength Binderless Coal Logs for Pipeline Transportation", Aug. 1994, pp. 1–106.

Zhuoxiong Liang, Masters of Science Thesis, University of Missouri—Columbia, "Compaction of Binderless Coal for Coal Log Pipelines", May, 1993, pp. 1–132.

M. V. Chari, Bechtel Group, Inc., "Thermal Upgrading of Law—Rank Coal a Process–Screening Study", Research Project 2221–11, Final Report, Mar. 1986, pp. 1–4, A1–A3, B1–B3, C1–C3, D1–D3 and R1–R2.

* cited by examiner

PROCESS FOR FORMING COAL COMPACTS AND PRODUCT THEREOF

The U.S. Government has rights in this invention pursuant to Contract No. NSF ECD-9108841 awarded by the National Science Foundation and Contract No. DOE DE-FC22-93PC92578 awarded by the Department of Energy.

BACKGROUND OF THE INVENTION

The present invention relates to a process for forming compacts from coal particulates which does not require use of a binder and to the coal compacts produced by the process. The process of the present invention can be used to form large, cylindrically-shaped compacts from coal particles (i.e., "coal logs") so that the coal can be transported in a hydraulic coal log pipeline.

Hydraulic coal log pipelines, such as that described and shown in U.S. Pat. No. 4,946,317 (Liu et al.), may be used to transport coal log compacts over long distances through a pipeline using water as a carrier fluid. In order to fully develop coal log pipeline technology as a commercially viable means of coal transport, it is necessary to develop processes for fabricating coal compacts which possess and retain sufficient mechanical strength to withstand the lengthy exposure to high pressure water and abrasion attendant pipeline transport.

It is generally known that loose coal particles can be formed into agglomerates or compacts (e.g., briquettes as well as other shapes) by compacting or extruding a mixture of coal particles and a solid or liquid binder additive (e.g., pitch, bitumen, cement, sodium silicate, sulfite lye, cellulose, starch and synthetic resins). However, the use of binders in forming coal compacts is generally undesirable because the binders add to the expense and complexity of the process, cause increased smoking when the compact is subsequently burned and render the compact generally unpleasant to handle. As a result, binderless coal compaction and extrusion processes have been developed.

Prior art binderless processes are capable of producing coal compacts having exceptional mechanical strength. However, prior art processes are typically used to produce small coal briquettes which are not intended to be exposed to the extreme pressures and degradation forces imposed by pipeline transportation. Conventional binderless coal compacts have a moisture content much lower than the saturation moisture content of the compact and, as a result, tend to exhibit a strong affinity for water. When these compacts are exposed to water, a substantial amount of water is absorbed into the structure of the compact causing significant volumetric expansion. The water-soaked compacts suffer from an excessive loss of mechanical strength and break apart. The degradation of mechanical strength induced by water absorption is exacerbated when the compacts are immersed in high pressure water such as that used in hydraulic coal log pipelines. The ability of a compact to repel water and not break apart when exposed to a high pressure water stream is of primary importance when the compact is prepared for transport in a coal log pipeline. Thus, prior art binderless processes for making coal compacts have not proved suitable for fabricating coal logs for pipeline transport.

SUMMARY OF THE INVENTION

Among the objects of the present invention, therefore, are the provision of coal compacts and a process for making coal compacts which do not require use of a binder; the provision of durable coal compacts which retain sufficient mechanical strength after exposure to high pressure water and other degradation forces imposed by hydraulic pipeline transportation and a process for making such coal compacts; the provision of coal compacts which possess increased heating value relative to the feed coal and a process for making such coal compacts; and the provision of a process for producing coal compacts efficiently and economically.

Briefly, therefore, the present invention is directed to a process for making compacts from coal particles. The process comprises heating a particulate feed comprising substantially water-saturated coal particles to a temperature greater than about 100° C. at a pressure sufficient to prevent water in the feed from boiling. The heated feed is compacted in a mold by applying a compressive stress to the heated feed to thereby form the compact. The compact is then cooled at a pressure sufficient to prevent water in the cooling compact from boiling.

The invention is further directed to a process for making compacts from coal particles which comprises preheating a particulate feed comprising substantially water-saturated coal particles at an ambient pressure of about 1 atmosphere to a temperature less than about 100° C. so that water in the feed does not boil. The preheated particulate feed is then compacted by applying a compressive stress to the preheated particulate feed in a mold. The compressive stress is sufficient to prevent water in the compacted feed from boiling when the compacted feed is subsequently heated to a final compaction temperature. The compact is then formed by heating the compacted particulate feed in the mold to the final compaction temperature while maintaining the compressive stress. The final compaction temperature is greater than about 100° C. The formed compact is cooled to an ejection temperature in the mold while maintaining sufficient compressive stress on the compact to prevent water in the compact from boiling. The ejection temperature is sufficiently low such that the compressive stress can be removed from the compact after cooling without inducing water in the compact to boil. The cooled compact is then ejected from the mold.

The invention is further directed to a coal compact comprising compacted coal particles. The compact has an original tensile strength of at least about $3.4\times10^5$ Pa (50 psi) and an original compressive strength of at least about 3.45 MPa (500 psi) after being formed and cooled to about 27° C. Furthermore, after being immersed in a static water bath pressurized to about 3.45 MPa (500 psi) gauge for a period of about 24 hours, the compact has a tensile strength of at least about 50% of the original tensile strength and a compressive strength of at least about 50% of the original compressive strength.

Other objects and features of this invention will be in part apparent and in part pointed out hereinafter.

DETAILED DESCRIPTION OF THE PREFERRED EMBODIMENTS

Figure 1:
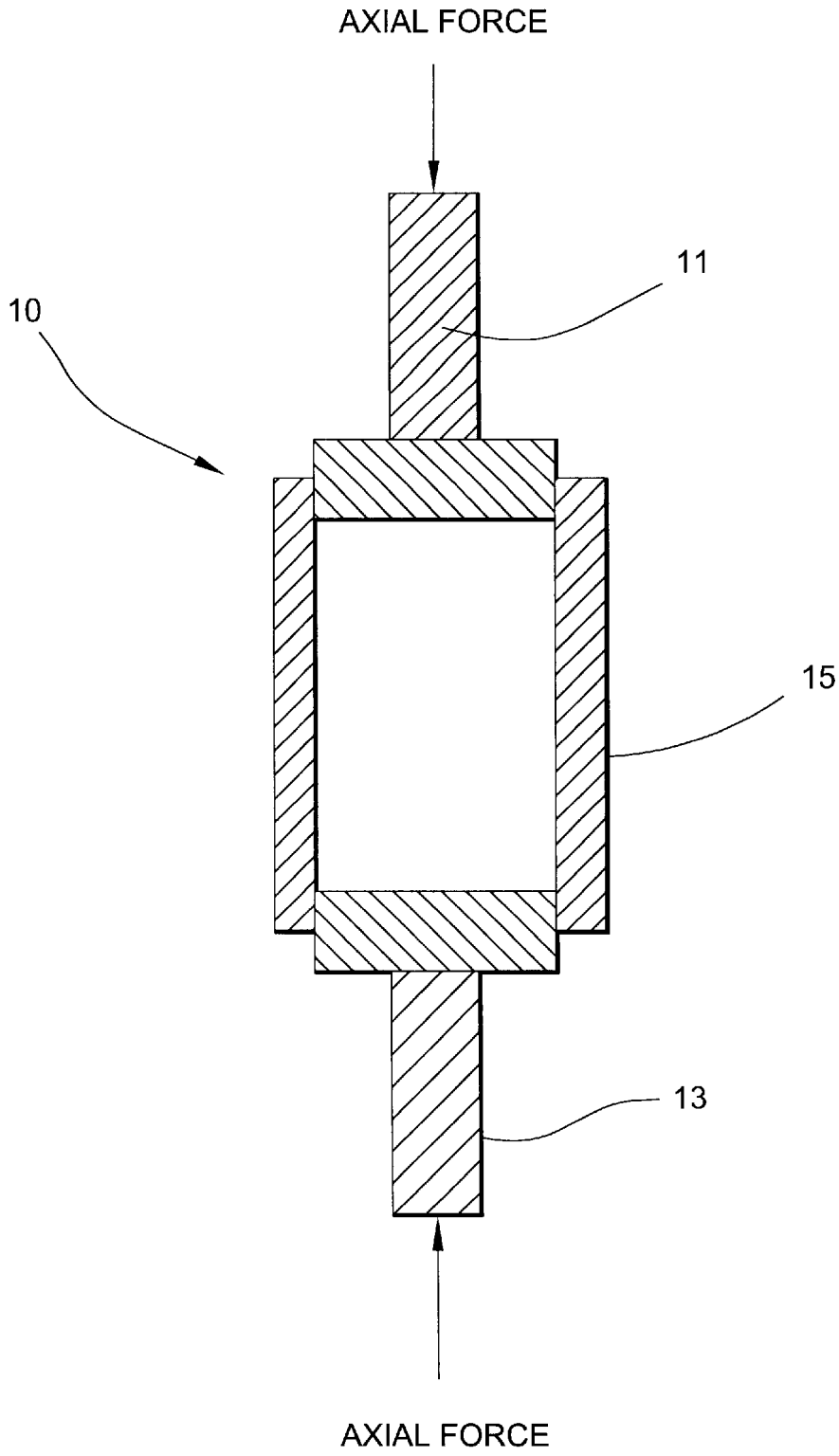
FIG. 1 is a schematic cross-sectional view of a suitable compaction apparatus which may be used in the practice of the present invention.

In accordance with the present invention, it has been discovered that if appropriate moisture, temperature and pressure conditions are created during the fabrication process, a mechanically strong, binderless coal compact having a reduced propensity to absorb water and weaken can be prepared. The compacts produced by the process described herein have a moisture content near their water saturation point. As a result, these compacts absorb little water and retain exceptional mechanical strength when immersed in high pressure water.

Several process conditions are important in the practice of the present invention. First, the particulate coal feed from which the compacts are formed is substantially water-saturated, and this condition is maintained during the compact forming process such that the compact has a moisture content near its saturation point. Secondly, the compact is formed by applying a compressive stress to the particulate feed in a mold while the feed is heated to a temperature greater than about 100° C. High temperature processing softens the coal particles, increasing plastic deformation of the coal and inter-particle contact when the feed is compacted. The enlarged area of contact strengthens the bonds between adjacent coal particles resulting in a stronger compact. Finally, in order to produce a substantially water-saturated compact, the water present in the feed must remain substantially in the liquid phase as the feed is heated to temperatures in excess of 100° C. during the compact forming process. This is achieved by heating and compressing the particulate feed and cooling the formed compact at a pressure sufficient to prevent water present in the feed from boiling.

The process of the present invention is described in detail below. The process varies somewhat depending on whether the process is practiced at an ambient pressure of about one atmosphere (i.e., $1.013\times10^5$ Pa) or in a hyperbaric environment in which the ambient pressure is controlled above one atmosphere.

The process is initiated by preparing a particulate feed comprising substantially water-saturated coal particles. The coal particles may comprise any of the solid, carbonaceous combustible materials commonly referred to as coal, including: lignite, anthracite, bituminous, subbituminous, brown coal, coal fines and mixtures thereof. The lower rank feed coals (e.g., lignite, subbituminous and brown coal) tend to form stronger compacts and are therefore preferred for making compacts in accordance with the process disclosed herein.

The coal particles in the particulate feed are substantially water-saturated. By substantially water-saturated it is meant that the moisture content of the particulate feed is at or near the water saturation point such that the particulate feed no longer exhibits a significant affinity for further water absorption. Preferably, the degree of saturation of the particulate feed, defined as the ratio of the volume of water in the feed particles to the volume of void space in the feed particles, is at least about 0.8, more preferably at least about 0.9. In some instances, the feed coal may be substantially water-saturated when the coal is mined and, in such instances, it is not necessary to add additional water to the feed coal. However, in those instances when the feed coal is not substantially water-saturated, additional water is combined with the coal.

The saturation of the feed coal may be accomplished by contacting the coal with liquid water or saturated steam. The rate at which feed coal having a moisture content below the saturation point absorbs the added water depends on a variety of factors such as the type of coal, the initial moisture content of the coal and particle size distribution. Whether the particulate feed is sufficiently water-saturated may be determined by monitoring the weight of the feed coal as it is contacted with additional water. Once the weight of the feed coal stabilizes and the coal no longer exhibits a significant affinity for further water absorption, it is substantially water-saturated.

Generally, the mechanical strength of the compacts is improved as the size of the coal particles in the particulate feed decreases. Smaller particles allow for a greater area of contact between adjacent coal particles bonded together in the compact, resulting in a stronger compact. Preferably, the coal particles which comprise the particulate feed are sized such that they pass through a No. 8 sieve (ASTM, "Standard Specification for Wire Cloth Sieves for Testing Purposes", Designation E11-87, Annual Book of ASTM Standards, Vol. 04.02, 729–732 (1991)), and have a maximum particle size of about 2.36 mm. More preferably, the coal particles which comprise the particulate feed are sized such that they pass through an ASTM No. 30 sieve and have a maximum particle size of about 0.6 mm. The feed coal may be ball-milled or subjected to some other suitable grinding process to reduce the particle size. Preferably, if additional water has to be added to the feed coal, the particle size of the feed coal is reduced prior to contacting the feed coal with liquid water or saturated steam. By reducing the particle size of the feed coal prior to contacting it with additional water, the coal may be made substantially water-saturated more readily due to the increased surface area in contact with the added water.

The particulate feed comprising substantially water-saturated coal particles is heated to a final compaction temperature greater than about 100° C., preferably to a temperature of at least about 125° C., more preferably to a temperature of at least about 150° C. Generally, the greater the final compaction temperature the stronger the resulting compact due to increased plastic deformation of the coal and greater inter-particle contact within the compact. However, because the coal in the particulate feed may decompose at higher temperatures, the final compaction temperature is preferably not in excess of about 250° C.

The particulate feed is heated to the final compaction temperature at a pressure sufficient to prevent water present in the feed from boiling. That is, the pressure exerted on water in the particulate feed is greater than the vapor pressure of the water as the feed is heated. Allowing the water present in the particulate feed to boil during the compact forming process is detrimental to the quality of the compact. The means by which water in the particulate feed is prevented from boiling is dependent upon whether the process is being practiced at an ambient pressure of about one atmosphere or in a hyperbaric environment in which the ambient pressure is controlled above one atmosphere.

If the process described herein is practiced at an ambient pressure of about one atmosphere, the particulate feed is charged to a suitable mold of a compaction apparatus and sufficient compressive stress is applied to the feed in the mold to prevent water present in the feed from boiling as the compacted feed is subsequently heated in the mold to the final compaction temperature.

In the case of coal log compacts, the mold used is preferably a cylinder of circular cross-section which is open at both ends and has an internal diameter sized so that the coal compact fits within the conduit of a coal log pipeline. Coal log compacts for transport in commercial scale hydraulic pipelines typically have a diameter of about 15 to about 50 cm, are about 30 cm to about 1 meter in length and have a length to diameter ratio of about 2 or less. FIG. 1 is a schematic cross-sectional view of a compaction apparatus 10 which may be used in the practice of the present invention to compact the particulate feed. The apparatus comprises a first piston 11, a second piston 13 and a cylindrical compaction mold 15 into which the particulate feed is charged. The filled mold is held between the two pistons. Compaction of the coal within the mold is achieved by applying an axial force to one or both of the pistons using appropriate means such as a hydraulic drive mechanism (not shown) connected to one or both of the pistons. Pistons 11 and 13 are sized to fit within the ends of the cylindrical mold 15 such that the pistons contact the feed substantially across the entire cross-section of the mold with a minimal gap (e.g., <0.25 mm) between the pistons and the wall of the mold.

Suitable compaction apparatus may have various configurations, including single action, double action and "floating cylinder." In both single and double action configurations, the mold is held in a fixed position relative to the two pistons. However, during the compaction stroke of a double action compaction apparatus, an axial force is applied to both pistons causing both pistons to move relative to the mold, while in a single action compactor, the axial force is applied to just one piston which moves relative to the mold and the other piston remains fixed. Single action compactors tend to produce compacts which are more dense near the end contacted by the moving piston because of friction between the feed and the wall of the mold. In double action compactors, friction between the feed and the mold produces compacts which tend to be more dense at both ends than in the middle. A floating cylinder configuration is similar to a single action compactor in that the axial force is applied to just one piston which moves relative to the mold while the other piston remains fixed. However, in a floating cylinder compactor, the mold filled with particulate feed is fixed in position between the two pistons during the compaction stroke only until enough wall friction develops to carry the weight of the mold, then the mold is released and allowed to move relative to both pistons as the feed is compacted. Floating cylinder and double action compactors tend to reduce the friction between the forming compact and the wall of the mold, providing a more uniform compressive stress over the length of the forming compact. As a result, the compact exhibits a more uniform density over its length. For this reason, floating cylinder and double action compactors are preferred in the practice of the present invention.

In order to prevent water in the forming compact from boiling, sufficient compressive stress must be maintained on the compacted feed within the mold such that the pressure exerted on the water within the forming compact exceeds the vapor pressure of water at the final compaction temperature. For laboratory scale coal log compacts (e.g., 5 cm diameter×9 cm length), it has been determined that a compressive stress of at least about 27.6 MPa (4000 psi) gauge maintained on the feed in the mold is sufficient to prevent water in the feed from boiling as the compacted feed is subsequently heated to a final compaction temperature up to about 200° C. By the gauge designation, it is meant the magnitude of the compressive stress in excess of the ambient pressure. The minimum compressive stress which must be maintained on the compacted particulate feed in order to prevent boiling varies with the magnitude of the final compaction temperature and the size of the compact and can be readily determined experimentally.

The compacted particulate feed may be heated within the mold to the final compaction temperature by any suitable means. For example, the mold may be heated by an electrical resistance heater or by contact with a suitable heat exchange fluid (e.g., steam) with this heat being subsequently transferred through the wall of the mold to the compacted feed.

In order to reduce the time required to heat the compacted coal within the mold to the final compaction temperature, the particulate feed comprising water-saturated coal particles is preferably preheated prior to being charged to the compaction mold. When the process is being practiced at an ambient pressure of about one atmosphere, the particulate feed is preheated at the ambient pressure to a temperature less than about 100° C. such that water in the feed does not boil during preheating. To maximize the benefits of preheating, the particulate feed is preferably preheated to a temperature of at least about 90° C. By preheating the particulate feed to a temperature of at least about 90° C., but less than the temperature necessary to boil water present in the feed at an ambient pressure of about one atmosphere, the void space between the loose coal particles is filled primarily with water in either the liquid or vapor phase and little air will be present. Air within the particulate feed tends to become trapped and pressurized in the compact when the feed is compacted, undermining the mechanical strength of the compact. By contrast, water vapor within the void spaces between coal particles in the feed condenses when pressurized and thus excess vapor phase pressure does not build up when the feed is subsequently compacted.

The particulate feed may be preheated by any suitable means including contacting the feed with warm liquid water or saturated steam. If warm liquid water or saturated steam are used to preheat the feed, saturation of the feed coal and preheating can occur simultaneously. Once the feed has been preheated, it is charged to the mold and compacted by applying a compressive stress to the preheated feed, the compressive stress being sufficient to prevent water in the compacted feed from boiling as the compacted feed is subsequently heated in the mold to the final compaction temperature.

Of course it should be understood that the particulate feed may be preheated to temperatures in excess of 100° C. outside of the mold, so long as the feed is preheated in a hyperbaric environment in which the ambient pressure exceeds one atmosphere and is maintained sufficiently high to prevent water in the feed from boiling during preheating. If a hyperbaric environment is employed in practicing the process of the present invention, the particulate feed is preferably heated directly to the final compaction temperature outside of the mold in the hyperbaric environment with the ambient pressure within the environment being maintained sufficiently high to prevent water present in the feed from boiling. By heating the feed to the final compaction temperature in the hyperbaric environment, the need to heat the feed further in the compaction mold while under load is eliminated. The particulate feed can be heated to the final compaction temperature in a hyperbaric environment by any suitable means, such as by contacting the feed with saturated steam at the final compaction temperature. Once the particulate feed is heated to the final compaction temperature in such an environment, it is charged to the mold of a suitable compaction apparatus.

Whether the process described herein is practiced at an ambient pressure of about one atmosphere or in a hyperbaric environment in which the ambient pressure is controlled above one atmosphere is largely an economic decision. By practicing the process in a hyperbaric environment, a larger portion of the processing may take place while the particulate feed is outside of the mold, allowing the output of the process to be increased without requiring an increase in the number of molds and attendant capital costs. Furthermore, the compaction apparatus may simplified since the feed does not need to be heated within the mold. However, the increase in output and simplification of the compaction apparatus must be balanced against the increase in capital costs associated with maintaining a suitable hyperbaric environment. In any event, we believe that in the commercial application of the process, the increase in process output and overall process simplification may in some instances more than justify the capital expenditures necessary to practice the present invention in a hyperbaric environment.

Whether the particulate feed has been heated to the final compaction temperature within a hyperbaric environment or heated to the final compaction temperature within the mold while under load, once the final compaction temperature is attained, the heated particulate feed is compacted by applying a compressive stress to the heated feed to form the compact. The magnitude and duration of the compressive stress applied to the heated particulate feed may vary considerably in the practice of the present invention depending upon the final compaction temperature and the size and desired mechanical strength of the compact. Generally, the greater the compressive stress applied to the feed while heated to the final compaction temperature, the greater mechanical strength exhibited by the resulting compact. Preferably, the compressive stress applied to the feed is at least about 34.5 MPa (5000 psi) gauge, more preferably at least about 68.9 MPa (10,000 psi) gauge and even more preferably at least about 138 MPa (20,000 psi) gauge.

Depending upon the final compaction temperature and the magnitude of the compressive stress applied to the feed at the final compaction temperature, the duration of the period that the compressive stress is applied to the feed (i.e., the load holding period) at the final compaction temperature may vary considerably in the practice of the present invention. As the final compaction temperature and the magnitude of the compressive stress increase, the load holding period may be essentially reduced to 0 and satisfactory results still achieved. Generally, the longer the load holding period at the final compaction temperature the stronger the compact. With laboratory scale coal log compacts (e.g., 5 cm diameter×9 cm length), a load holding period of about 1 minute is usually sufficient to achieve desirable results.

Generally, the strength of the compact increases as the loading and unloading rates by which the compressive stress at the final compaction temperature is applied to the feed and removed from the compact decrease. Therefore, it is preferred that the loading and unloading rates of the compressive stress at the final compaction temperature be less than about 2.5 MPa/s, more preferably less than about 0.5 MPa/s.

It should be understood that if the feed is heated to the final compaction temperature in the mold while under load, the compressive stress applied to the heated feed by the compaction apparatus to prevent water in the compacted feed from boiling may be sufficient to form a suitable compact once the compacted feed is heated to the final compaction temperature. Preferably, however, in order to minimize the energy requirements of the compaction apparatus, the magnitude of the compressive stress applied to the feed in the mold prior to the feed reaching the final compaction temperature does not greatly exceed the minimum value necessary to prevent water in the compacted feed from boiling. Thus, in such instances, once the compacted feed is heated to the final compaction temperature, the compressive stress applied to the compacted feed is preferably increased in order to produce a stronger compact.

After the compressive stress applied to the compacted feed heated to the final compaction temperature has been maintained for the requisite load holding period to form the compact, the compact is cooled at a pressure sufficient to prevent water in the cooling compact from boiling. If the process is conducted in a hyperbaric environment in which the ambient pressure is sufficient to prevent water from boiling at the final compaction temperature, the compressive stress may be removed immediately from the formed compact and the compact ejected from the mold into the hyperbaric environment and allowed to cool. In this case, the ambient pressure in the hyperbaric environment must be maintained sufficiently high as to prevent water in the compact from boiling as it cools. Once the compact has cooled to a temperature that is less than 100° C., the compact can be transferred from the hyperbaric environment to an environment in which the ambient pressure is one atmosphere.

If the process is conducted at an ambient pressure of about one atmosphere, a compressive stress must be maintained on the compact in the mold as the compact cools in order to prevent water in the compact from boiling. However, once the requisite load holding period has elapsed, the compressive stress applied to the compact may be reduced so long as the pressure exerted on water in the cooling compact exceeds the vapor pressure of the water. If sufficient compressive stress is not maintained on the compact as it cools in the mold, the water in the compact will flash off, resulting in a decrease in compact strength. Flashing of water in the compact may be evidenced by ejection of steam from the mold of the compaction apparatus. In order to avoid flash boiling of water in the compact, the compact should be allowed to cool in the mold to an ejection temperature while maintaining sufficient compressive stress on the compact to prevent water in the compact form boiling. The ejection temperature must be sufficiently low such that the compressive stress can be completely removed from the compact after cooling to the ejection temperature without inducing water in the compact to boil. If the process is conducted at an ambient pressure of one atmosphere, the ejection temperature must be less than 100° C. Once the compact has cooled to the ejection temperature in the mold, the compressive stress may be removed and the compact ejected from the mold.

The mold may be of single piece construction. Cylindrical compacts are removed from single piece molds by forcing the compact to exit the opening at one end of the mold. However, friction between the wall of the mold and the compact may cause the compact to crack and weaken as it is forced from the mold. For this reason, single piece molds are preferably tapered so that the inside diameter of the mold increases slightly from one end to the other. This allows the compact to be forced from the mold more easily through the opening having the larger inside diameter, reducing cracking. Alternatively, the mold may be formed from two or more integral pieces which are joined together to form the mold. For example, a split mold comprising two rectangular blocks of steel, each having a semicircular groove extending the length of the block may be used. The blocks are bolted together such that the grooves align and form a cylindrical mold of circular cross-section. After a compact is formed, the compact is ejected from the mold by loosening the bolts and separating the mold into its two component halves. Split molds are preferred in the practice of the present invention because the compact does not have to be forced from the mold, thereby reducing the tendency of the compact to crack and weaken. However, whether a single piece or split mold is employed, the forming compact may develop cracks during the compact forming process as a result of friction between the wall of the mold and the feed as the compressive stress is applied to the feed. In order to reduce the likelihood of cracks forming, the walls of the mold in contact with the feed are preferably coated with a friction reducing layer such as chrome plating. Chrome plating decreases friction and adhesion between the forming compact and the mold so that crack formation is reduced.

It should be understood that the compaction apparatus used in the practice of the present invention is not limited to a compactors in which the compressive stress is applied to the heated feed by pistons, but that the process could be adapted to other compaction apparatus known to those skilled in the art. For example, the compacts could be formed using an extruder, the compressive stress needed to form the compact being applied to the feed as the compact is forced through the extruder die. If such alternative compaction apparatus are employed, the practice of the process described herein is not otherwise materially changed.

We refer to the process described herein as the Hot Water Forming (HWF) process and to coal logs produced by this process as Hot Water Formed or HWF compacts. HWF compacts are dense, have a moisture content near their saturation point and exhibit and retain exceptional mechanical strength even after lengthy exposure to high pressure water such as that found in hydraulic coal log pipelines.

We believe that HWF coal compacts develop their improved strength and water resistance through several mechanisms. First, by substantially water-saturating the particulate feed and processing the feed in an aqueous environment, the nature of the particle to particle bonding changes. If dry coal particle surfaces are pressed closely together, under appropriate conditions, the particles will bind together, forming a compact. However, the bonds in a compact formed from dry coal are generally not stable when exposed to water, especially high pressure water. It is speculated that the dry coal has a great affinity for water and thus particle to particle bonds are broken and the compact disintegrates when it is exposed to water. Second, by starting the process with substantially water-saturated coal particles and preventing water in the forming compact from boiling, the resulting compact is also substantially water-saturated. Therefore, the compact absorbs very little water when it is exposed to water. Conversely, when unsaturated coal compacts are exposed to water, a significant volumetric expansion of the compact and excessive loss of strength occurs. Third, by forming the compact at temperature greater than 100° C. the benefits of high temperature processing on improved mechanical strength are realized. Forming compacts at temperatures above 100° C. greatly increases the mechanical strength of the compact.

As noted previously, compacts produced by the HWF process have a moisture content near their water saturation point. As a result, these compacts absorb little water and retain exceptional mechanical strength when immersed in high pressure water. This characteristic is important in compacts intended for transport in a hydraulic pipeline.

A water absorption test is one way of evaluating the capability of HWF compacts to retain their mechanical strength after immersion in high pressure water. In the commercial operation of coal log pipelines, the maximum water pressure at the pump is expected to be at least about 3.45 MPa (500 psi) gauge. Therefore, to simulate exposure in a commercial pipeline, coal compacts may be immersed in a static water bath pressurized to 3.45 MPa (500 psi) gauge for a period of about 24 hours. After being subjected to the water absorption test, the tensile and compressive strength exhibited by the compacts may be measured and compared to the original tensile and compressive strengths of the compact before the test to determine the extent to which the strength of the compact was retained.

The mechanical strength and resistance to water absorption exhibited by coal compacts produced by the HWF process are effected by variety of factors noted in the preceding text. The primary factors which increase compact strength and improve resistance to water absorption include: greater final compaction temperature, increased magnitude of the compressive stress applied to the particulate feed at the final compaction temperature and a longer load holding period. By controlling these primary factors as well as the other various parameters of the HWF process as described herein, the mechanical strength and resistance to water absorption of the compact can be controlled.

Preferably, the process parameters of the HWF process are controlled such that the compact has an original tensile strength of at least about $3.4\times10^5$ Pa (50 psi) and an original compressive strength of at least about 3.45 MPa (500 psi) after being formed and cooled to ambient temperature (e.g., about 27° C.) and has tensile and compressive strengths of at least about 50% of the original tensile and compressive strengths after being subjected to the water absorption test. More preferably, the coal compact produced by the HWF process has an original tensile strength of at least about 8.27 $10^5$ Pa (120 psi) and an original compressive strength of at least about 6.895 MPa (1000 psi) after being formed and cooled to ambient temperature and has tensile and compressive strengths of at least about 70% of the original tensile and compressive strengths after being subjected to the water absorption test. In an especially preferred embodiment of the present invention, the HWF compact has an original tensile strength of at least about 1.24 MPa (180 psi) and an original compressive strength of at least about 10.34 MPa (1500 psi) after being formed and cooled to ambient temperature and has tensile and compressive strengths of at least about 90% of the original tensile and compressive strengths after being subjected to the water absorption test.

The tensile strengths of the HWF compacts referred to above are determined using the ASTM procedure entitled "Standard Test Method for Splitting Tensile Strength of Cylindrical Concrete Specimens", Designation C496-90, Annual Book of ASTM Standards, Vol. 04.02, 266–269 (1991). The compressive strengths of the HWF compacts referred to above are determined using the ASTM procedure entitled "Standard Test Method for Compressive Strength of Cylindrical Concrete Specimens", Designation C39-86, Annual Book of ASTM Standards, Vol. 04.02, 20–23 (1991).

A secondary benefit of the HWF process is that the equilibrium or saturation moisture content of the coal in the compact is reduced relative to the feed coal. That is, the maximum water content of the HWF compacts is less than the maximum water content of the feed coal. Thus, the heating value of the coal in the compact is increased relative to the feed coal. The decrease in the saturation moisture content of the coal in the compact is believed to occur because, at the pressures and temperatures maintained in the forming compact during the HWF process, water is removed irreversibly from the coal particles and out of the void space between adjacent coal particles. Also, it is believed that carboxyl groups and alkalis are released from the coal particles and coal tars move to the surface of the coal particles. The coal tars are hydrophobic and remain on the surface of the particles in the pressurized aqueous environment and produce a coating that seals the pores in the particles, thus sealing the particles from subsequent moisture reabsorption. The HWF process may significantly reduce the saturation moisture content of low rank coals. Furthermore, the movement of the coal tar to the particle surfaces allows the tar to help bind the particles together. However, it should be noted that this tar is not added from any extraneous source, but is present in the feed coal. Although the particulate feed in the HWF process does not have to include a binder additive, it should be understood that such a binder may nevertheless be employed to improve the mechanical strength of the compact. Preferably, the particulate feed and the coal compact produced are essentially free of extraneous binders.

The present invention is illustrated by the following Examples which are merely for the purpose of illustration and are not to be regarded as limiting the scope of the invention or manner in which it may be practiced.

EXAMPLE 1

Laboratory scale coal logs having a diameter of about 5 cm and a length of about 9 cm were produced in accordance with the HWF process of the present invention from coal mined at several different locations. In this Example, the process was practiced at ambient pressure.

A proximate analysis of the five different types of feed coal used in this Example was conducted according to American Society of Testing Materials (ASTM), "Proximate Analysis of Coal and Coke", Designation D3172-89, Annual Book of ASTM Standards, Vol. 05.05, 307 (1990). The results of this analysis are shown below in Table 1. Because the moisture content of the coal was changed to make the coal logs, the proximate analysis was conducted on oven-dry coal.

TABLE 1

| Coal | Saturation Moisture Content % total weight (% dry weight) | Volatile Matter % dry weight | Ash % dry weight | Fixed Carbon % dry weight | Sulfur % dry weight | Energy Content Dry Weight MJ/kg |
|---|---|---|---|---|---|---|
| Powder River Basin | 27.1 (37.2) | 43.8 | 8.0 | 48.2 | 0.7 | 27.1 |
| Antelope | 26.4 (35.9) | 41.2 | 6.1 | 52.7 | 0.4 | 29.7 |
| Illinois | 8.6 (9.4) | 39.3 | 10.0 | 50.7 | 2.9 | 29.6 |
| Arch Mineral | 5.2 (5.5) | 38.3 | 12.3 | 49.5 | 0.4 | 26.9 |
| Mapco | 1.7 (1.7) | 17.6 | 20.3 | 62.1 | 2.2 | 28.3 |

Feed coal, having a maximum particle size of about 9.5 mm was soaked in water at atmospheric pressure for a minimum of 12 hours to substantially water saturate the coal.

Approximately 300 grams of the saturated coal was then placed in a ball mill and ground for 30 minutes. After grinding, the saturated coal was drained to remove excess surface moisture and sieved. The portion of the ball-milled coal which passed through a No. 8 sieve (ASTM, "Standard Specification for Wire Cloth Sieves for Testing Purposes", Designation E11-87, Annual Book of ASTM Standards, Vol. 04.02, 729–732 (1991)), having a maximum particle size of 2.36 mm was used to make coal logs while the remainder was discarded. Only a small amount of the ball-milled coal was discarded. The particle size distribution of the portion used to make coal logs varied somewhat from one type of feed coal to another.

The sized, saturated coal was charged to a single piece, stainless steel cylindrical mold at room temperature and the filled mold was placed between the pistons of a floating cylinder compaction apparatus as described above. The cylindrical mold was surrounded by resistive heaters. A temperature control system for the resistive heaters was used to set and control the temperature of the mold and particulate feed during compaction of the coal. During compaction, axial load and deformation data were collected. A computer based data acquisition system was used for the collection and processing of this data.

Figure 2:
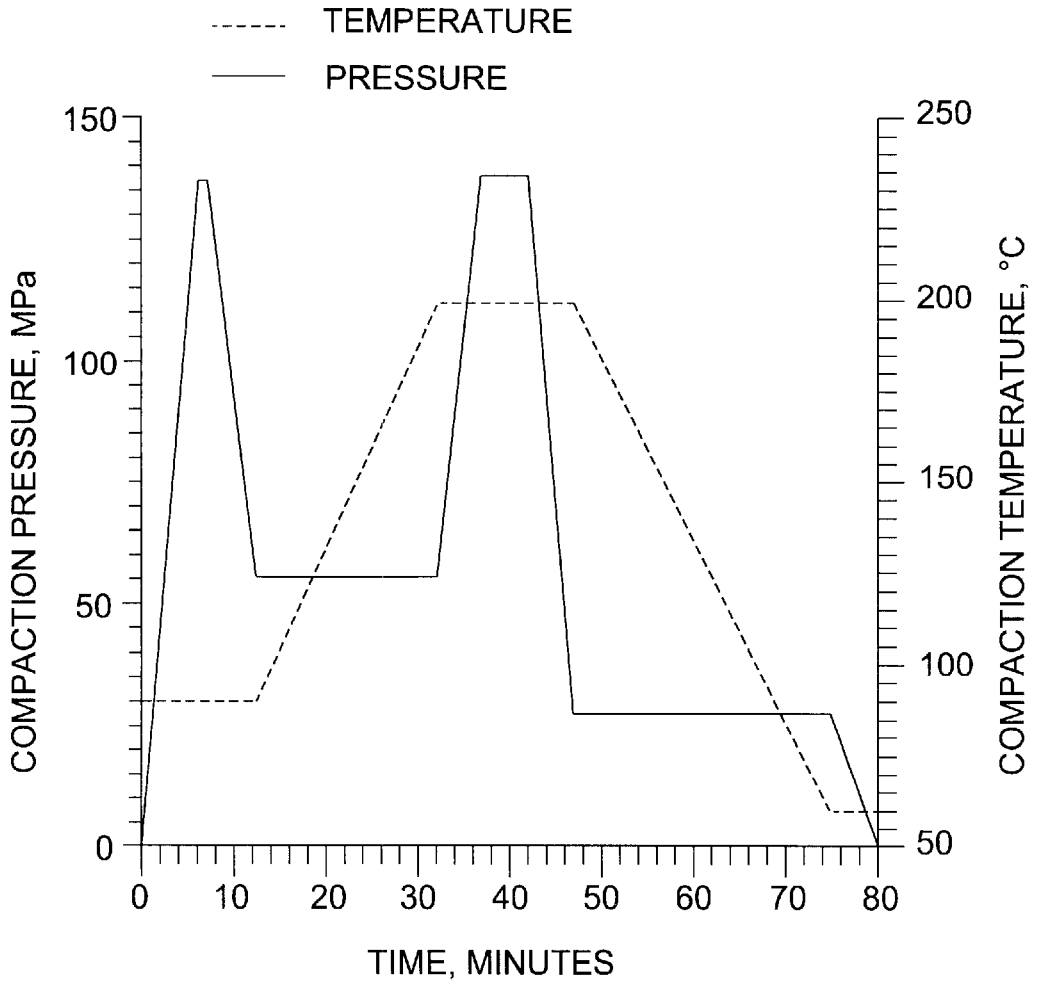
FIG. 2 is an example of a suitable compressive stress and temperature schedule used to make coal logs in Example 1.

An example of a suitable compressive stress and temperature schedule used to make coal logs in this Example is shown in FIG. 2. According to this schedule, the resistive heaters surrounding the mold were activated to preheat the room temperature mold and particulate feed until the temperature of the wall of the mold was about 90° C. Since the temperature was measured at the wall of the compaction mold, it was essentially the same as the temperature of the outer surface of the particulate feed in the mold. Furthermore, given the relatively small diameter of the mold, the temperature gradient between the feed near the wall and the feed at the center of the mold was believed to be minimal.

An axial force was then applied to the movable piston of the compaction mold apparatus such that the compressive stress on the preheated feed was raised from 0 to about 138 MPa (20,000 psi) gauge over a period of about 6 minutes. This compressive stress was maintained for about 1 minute and then lowered to approximately 55 MPa (8,000 psi) gauge over a period of about 5 minutes. While maintaining a 55 MPa gauge compressive stress on the compacted feed, the resistive heaters surrounding the mold were used to heat the mold and the feed to a final compaction temperature of about 200° C. measured at the wall of the mold. The compressive stress on the compacted feed was then increased to about 138 MPa (20,000 psi) gauge over a period of about 5 minutes, maintained at this value for about five minutes and then decreased to about 27.5 MPa (4,000 psi) gauge over a period of about 5 minutes. While maintaining a compressive stress of about 27.5 MPa (4,000 psi) gauge on the formed compact, the resistive heaters surrounding the mold were deactivated and the mold and compact were allowed to cool until the temperature of the wall of the mold was reduced to about 60° C. The cooled compact was then ejected from the mold.

All of the logs were made using a compressive stress and temperature schedule similar to the schedule described above and shown in FIG. 2. The principle difference being the time required for heating to the final compaction temperature and cooling of the coal log compact to 60° C. In fabricating each of the logs, the compressive stress applied to the particulate feed and formed compact in the mold was sufficient to prevent water present in the feed and compact from boiling and no evidence of boiling was observed.

After the cooled logs were ejected from the mold, they were weighed and allowed to cool further to ambient temperature before being subjected to various performance evaluations. The length and diameter of the logs were measured using a micrometer. Using these measurements, the bulk specific gravity of the logs was calculated.

An infrared lamp moisture balance was used to determine moisture content of the coal logs. The moisture content on a total weight basis ($\Phi_{tot}$) is defined as:

$$\Phi_{tot} = \frac{\text{wet weight of coal} - \text{dry weight of coal}}{\text{wet weight of coal}}$$

The moisture content on a dry weight basis ($\Phi_{dry}$) is defined as:

$$\Phi_{dry} = \frac{\text{wet weight of coal} - \text{dry weight of coal}}{\text{dry weight of coal}}$$

The numerator in both these expressions is the same. Therefore, because the wet weight is always greater than the dry weight, $\Phi_{dry}$ will always be larger than $\Phi_{tot}$. Values for both $\Phi_{tot}$ and $\Phi_{dry}$ are given in the tables below. If the basis for the moisture content is not stated, it is a total weight basis moisture content ($\Phi_{tot}$). Both moisture contents are included for clarity, because the conventional definition of moisture content varies between different fields of engineering and science.

The compressive strength of the coal logs was measured using the ASTM procedure entitled "Standard Test Method for Compressive Strength of Cylindrical Concrete Specimens", Designation C39-86, Annual Book of ASTM Standards, Vol. 04.02, 20–23 (1991). The tensile strength of the logs was measured using the ASTM procedure entitled "Standard Test Method for Splitting Tensile Strength of Cylindrical Concrete Specimens", Designation C496-90, Annual Book of ASTM Standards, Vol. 04.02, 266–269 (1991). The only difference between the compressive and tensile strength test methods used and the ASTM standard methods was the size of the test specimens. Both compressive and tensile strengths were measured on logs that were nominally 4.5 cm in diameter and 6.4 to 7.6 cm in length. In some instances, the compressive and tensile strength of logs were measured prior to water absorption testing (described below). In these cases, the strengths are referred to as "pre-absorption" strengths. Strength tests conducted after water absorption testing, but prior to degradation testing (described below) are referred to as "post-absorption" strengths. Finally, strength tests conducted after degradation testing are referred to as "post-degradation" strengths.

In order evaluate the durability of the coal logs produced in this Example when exposed to the severe conditions of hydraulic pipeline transport, logs were subjected to both water absorption and pipeline degradation testing. In the commercial operation of coal log pipelines, the maximum water pressure at the pump is expected to be at least about 3.45 MPa (500 psi) gauge. Therefore, to simulate exposure in a commercial pipeline, coal logs produced in this Example were immersed in water at a static pressure of about 3.45 MPa (500 psi) gauge for about 24 hours. This constituted the water absorption test.

Degradation testing of coal logs produced in this Example was conducted by circulating logs in a laboratory scale test pipeline. The test pipeline used for degradation testing was a horizontal recirculating closed-loop system having a length of about 22.8 meters (75 feet) and comprised a thin-walled, galvanized steel pipeline with an inside diameter of about 5.5 cm (2.17 inch). The system included two annular jet pumps which propelled the coal logs and the water through the pipeline without impeding the log motion. The two jet pumps operating together could move water through the pipeline at a maximum velocity of about 4 m/s (13 fps). The system further comprised a heat exchanger for maintaining a constant water temperature during testing.

During degradation testing, coal logs were circulated in the test pipeline at their "macro lift-off" velocity. As the water in the pipeline started to flow, the velocity of water was low and the log did not move. As the water velocity increased, a threshold velocity was reached at which the log began to slide within the pipeline with a layer of water trapped between the rough elements of the contacting surface between the log and the pipeline. As the water velocity continued to increase, more water was trapped between the log and the pipeline and "micro lift" of the coal log was achieved. At even greater water velocity, the logs were lifted further off the surface of the pipeline and became free-flowing within the pipeline. This free-flowing condition was achieved when the water and log circulating within the pipeline reached the macro lift-off velocity. It is preferred to operate coal log pipelines at the macro lift-off velocity because under such conditions, energy losses are approximately the same as that of an equivalent pipeline flow of water without logs.

It is believed that the degradation testing conducted in the test pipeline was an accelerated degradation test which fairly mimicked actual degradation expected to occur in a commercial scale pipeline over time. Degradation was accelerated due to the passage of the logs through the jet pumps, the presence of a large number of joints in the test pipeline, the presence of two small radius 180° bends in the pipeline, and the fact that a single log was circulated during the test. It is believed that coal logs which can circulate in the test pipeline at macro lift-off velocity for 1 hour with a weight loss of about 3% or less would perform exceptionally well in a wide range of commercial scale pipelines.

A number of coal logs were made from the Powder River Basin coal using a single piece, stainless steel cylindrical mold and a compressive stress and temperature schedule similar to that shown in FIG. 2. Table 2 summarizes the pre and post-water absorption moisture contents, specific gravities, compressive strengths and tensile strengths for these logs.

TABLE 2

| Evaluation Test | Number of Logs | Average | Standard Deviation |
|---|---|---|---|
| Pre-absorption moisture content | 6 | 16.05% ($\Phi_{tot}$)<br>19.11% ($\Phi_{dry}$) | 0.11% ($\Phi_{tot}$) |
| Post-absorption moisture content | 8 | 20.43% ($\Phi_{tot}$)<br>25.58% ($\Phi_{dry}$) | 0.52% ($\Phi_{tot}$) |
| Pre-absorption specific gravity | 6 | 1.258 | 0.009 |
| Post-absorption specific gravity | 8 | 1.316 | 0.008 |
| Pre-absorption compressive strength | 3 | 23.8 MPa (3460 psi) | 3.63 MPa (527 psi) |
| Post-absorption | 4 | 17.3 MPa (2500 psi) | 2.08 MPa (302 psi) |

TABLE 2-continued

| Evaluation Test | Number of Logs | Average | Standard Deviation |
|---|---|---|---|
| compressive strength | | | |
| Pre-absorption tensile strength | 3 | 1.28 MPa (186 psi) | 0.27 MPa (39 psi) |
| Post-absorption tensile strength | 4 | 0.67 MPa (97 psi) | 0.089 MPa (13 psi) |

Although the standard deviations are somewhat high, it can be seen from the data in Table 2 that the compressive strength of these logs was substantially larger than their tensile strength, and that there was a significant loss of strength after exposure to high pressure water in the water absorption test. Variations in moisture content and specific gravity of the logs were less than variations in log strength. It is important to note that the post-absorption moisture content of these logs ($\Phi_{tot}$) was about 21%. This is less than the 27% saturation moisture content of the Powder River Basin coal (see Table 1). Therefore, some lowering of the coal's saturation moisture content occurred as a result of the HWF process and the heating value relative to the feed coal was improved.

In spite of the loss of strength due to water absorption testing, the logs made from Powder River Basin coal performed quite well during degradation testing. The results are summarized below in Table 3.

TABLE 3

| Log No. | Circulation Time (minutes) | Number of Circulation Cycles | Weight Loss after 1 Hour Circulation (%) | Weight Loss at Termination of Test (%) |
|---|---|---|---|---|
| 1 | 300 | 1440 | 2.70 | 9.89 |
| 2 | 180 | 864 | 2.88 | 3.6 |
| 3 | 155 | 744 | 2.79 | 4.05 |

TABLE 3-continued

| Log No. | Circulation Time (minutes) | Number of Circulation Cycles | Weight Loss after 1 Hour Circulation (%) | Weight Loss at Termination of Test (%) |
|---|---|---|---|---|
| 4 | 140 | 672 | 2.71 | 3.52 |
| 5 | 70 | 336 | 3.00 | 3.31 |
| 6 | 30 | 144 | — | 3.28 |
| 7 | 30 | 144 | — | 3.33 |

Five of the seven logs tested were circulated in the test pipeline for longer than one hour prior to breaking. The weight loss at the end of one hour of circulation for these five logs was 3% or less. Weight loss during degradation testing was primarily due to abrasion of the trailing end of the logs against the pipeline. Also, small pieces were occasionally chipped off the compact. Logs eventually failed by breaking into two smaller cylinders of approximately the same size. This resulted in log pieces with length to diameter ratios less than one which can jam in the pipeline. The log breaks were generally quite clean. When the log failed before termination of the test, the final weight data is the sum of the weights of the pieces. Thus, in these cases, the weight loss data includes weight loss which occurred as a result of log failure. It was observed that many of these logs had visible circumferential cracks that became larger as the log was circulated in the pipeline. It is believed that these cracks eventually caused the logs to fail.

Coal logs were also made from the other feed coals listed in Table 1. These compacts were made by employing a compressive stress and temperature schedule similar to that shown in FIG. 2 in which a compressive stress of about 138 MPa (20,000 psi) gauge was applied to the feed while the feed was heated to a final compaction temperature of about 200° C. Table 4 below contains average evaluation data for these logs. Log strengths were greater for the lower rank subbituminous coals (Powder River Basin and Antelope). There was some lowering of the coal's saturation moisture content for all the feed coals except the high rank bituminous Mapco coal.

TABLE 4

| Evaluation Test | Powder Riber Basin | Antelope | Arch Mineral | Illinois | Mapco |
|---|---|---|---|---|---|
| Pre-absorption moisture content (%) | 16.0 ($\Phi_{tot}$) ($\sigma_6$ = 0.14) 19.0 ($\Phi_{dry}$) | 4.4 ($\Phi_{tot}$) ($\sigma_6$ = 0.28) 10.6 ($\Phi_{dry}$) | 9.6 ($\Phi_{tot}$) ($\sigma_6$ = 0.28) 10.6 ($\Phi_{dry}$) | 7.3 ($\Phi_{tot}$) ($\sigma_6$ = 0.66) 7.9 ($\Phi_{dry}$) | 1.9 ($\Phi_{tot}$) ($\sigma_{12}$ = 0.15) 1.9 ($\Phi_{dry}$) |
| Post-absorption moisture content (%) | 20.8 ($\Phi_{tot}$) ($\sigma_9$ = 1.17) 26.3 ($\Phi_{dry}$) | 19.7 ($\Phi_{tot}$) ($\sigma_6$ = 0.562) 24.5 ($\Phi_{dry}$) | 13.9 ($\Phi_{tot}$) ($\sigma_6$ = 0.612) 16.1 ($\Phi_{dry}$) | 10.2 ($\Phi_{tot}$) ($\sigma_{11}$ = 1.62) 11.4 ($\Phi_{dry}$) | 5.8 ($\Phi_{tot}$) ($\sigma_{12}$ = 0.62) 6.2 ($\Phi_{dry}$) |
| Pre-absorption specific gravity | 1.260 ($\sigma_{11}$ = 0.015) | 1.257 ($\sigma_{12}$ = 0.005) | 1.310 ($\sigma_{12}$ = 0.008) | 1.286 ($\sigma_{23}$ = 0.008) | 1.306 ($\sigma_{18}$ = 0.021) |
| Post-absorption specific gravity | 1.317 ($\sigma_9$ = 0.007) | 1.317 ($\sigma_6$ = 0.002) | 1.345 ($\sigma_6$ = 0.003) | 1.323 ($\sigma_{16}$ = 0.004) | 1.356 ($\sigma_{12}$ = 0.12) |
| Pre-absorption compressive strength | 23.8 MPa ($\sigma_3$ = 2.96) 3460 psi ($\sigma_3$ = 430) | 14.2 MPa ($\sigma_3$ = 0.25) 2066 psi ($\sigma_3$ = 36) | 11.3 MPa ($\sigma_3$ = 0.30) 1634 psi ($\sigma_3$ = 44) | 8.0 MPa ($\sigma_4$ = 1.17) 1164 psi ($\sigma_4$ = 170) | 4.8 MPa ($\sigma_3$ = 0.80) 697 psi ($\sigma_3$ = 12) |
| Post-absorption compressive strength | 13.8 MPa ($\sigma_4$ = 2.42) 2000 psi ($\sigma_4$ = 351) | 12.3 MPa ($\sigma_3$ = 1.09) 1791 psi ($\sigma_3$ = 158) | 6.77 MPa ($\sigma_3$ = 0.55) 982 psi ($\sigma_3$ = 80) | 6.06 MPa ($\sigma_4$ = 0.10) 879 psi ($\sigma_4$ = 135) | 3.44 MPa ($\sigma_4$ = 0.28) 499 psi ($\sigma_4$ = 41) |
| Pre-absorption tensile strength | 1.28 MPa ($\sigma_3$ = 0.22) | 1.41 MPa ($\sigma_3$ = 0.10) | 0.79 MPa ($\sigma_3$ = 0.11) | 0.89 MPa ($\sigma_3$ = 0.02) | 0.30 MPa ($\sigma_3$ = 0.07) |

TABLE 4-continued

| Evaluation Test | Powder Riber Basin | Antelope | Arch Mineral | Illinois | Mapco |
|---|---|---|---|---|---|
| Post-absorption tensile strength | 186 psi ($\sigma_3$ = 32) 0.67 MPa ($\sigma_4$ = 0.08) 97 psi ($\sigma_4$ = 11) | 204 psi ($\sigma_3$ = 14) 0.96 MPa ($\sigma_3$ = 0.03) 139 psi ($\sigma_3$ = 4) | 115 psi ($\sigma_3$ = 16) 0.30 MPa ($\sigma_3$ = 0.02) 44 psi ($\sigma_3$ = 3) | 129 psi ($\sigma_3$ = 3) 0.53 MPa ($\sigma_3$ = 0.002) 77 psi ($\sigma_3$ = 0.4) | 43 psi ($\sigma_3$ = 10) 0.23 MPa ($\sigma_5$ = 0.03) 33 psi ($\sigma_5$ = 4) |

$\sigma_{Sample\ n}$ = standard deviation; n = number of logs in sample

EXAMPLE 2

Systematic studies of the variation of post-absorption tensile strength and post-absorption moisture content, $\Phi_{tot}$, with the final compaction temperature and the compressive stress applied to the feed at the final compaction temperature were conducted using logs made from Powder River Basin coal in accordance with the procedures described in Example 1. The coal logs studied in this Example had essentially the same dimensions as those made in Example 1. The results of these studies are shown graphically in FIGS. 3 and 4.

Figure 3:
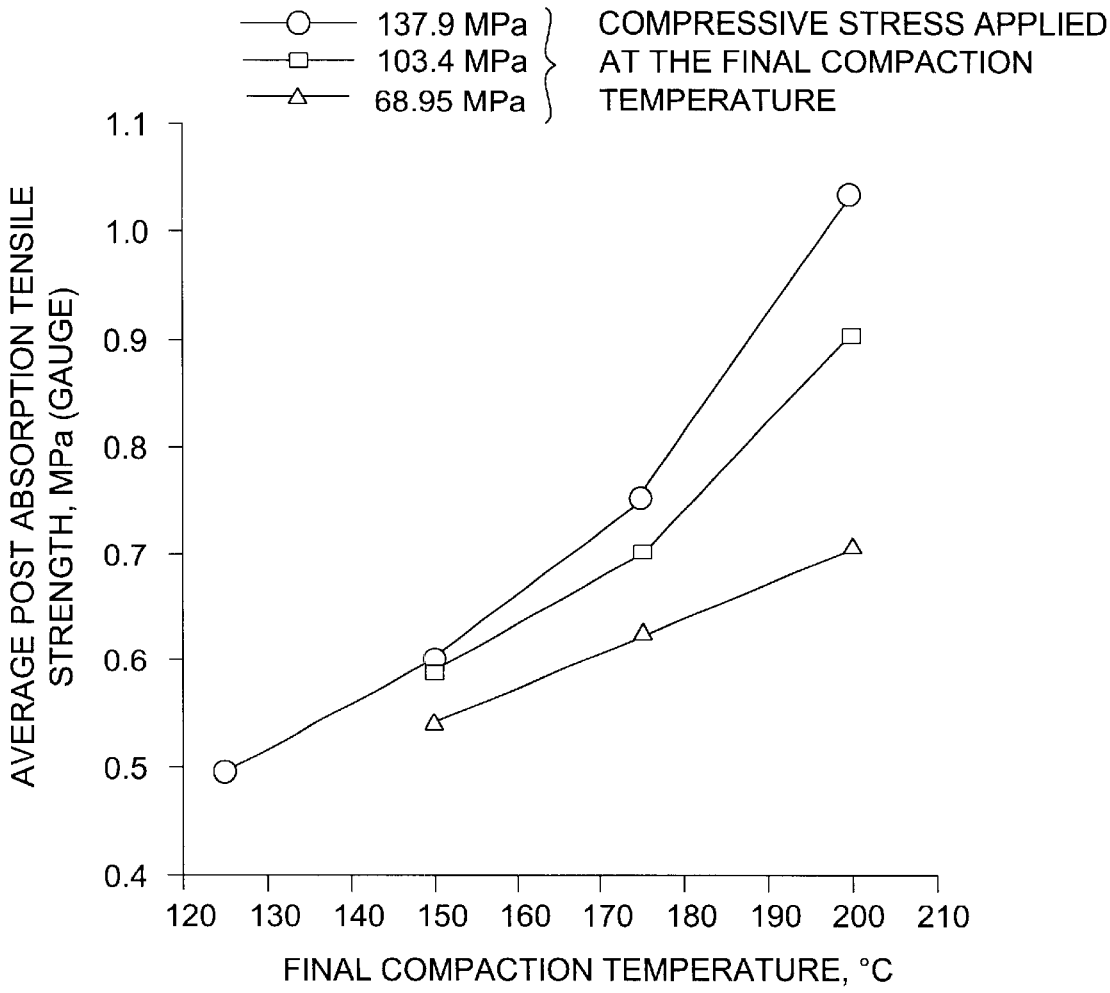
FIG. 3 is a graph showing the variation of average post-absorption tensile strength with the final compaction temperature and the compressive stress applied to the feed at the final compaction temperature for coal log compacts made in Example 2.

FIG. 3 is a graph showing the variation of post-absorption tensile strength with the final compaction temperature and the compressive stress applied to the feed at the final compaction temperature. As shown in FIG. 3, the post-absorption tensile strength of the compacts increased as both the final compaction temperature and compressive stress applied to the feed at the final compaction temperature were increased. At higher final compaction temperatures, the increase in tensile strength per unit increase in the compressive stress applied at the final compaction temperature was greater.

Figure 4:
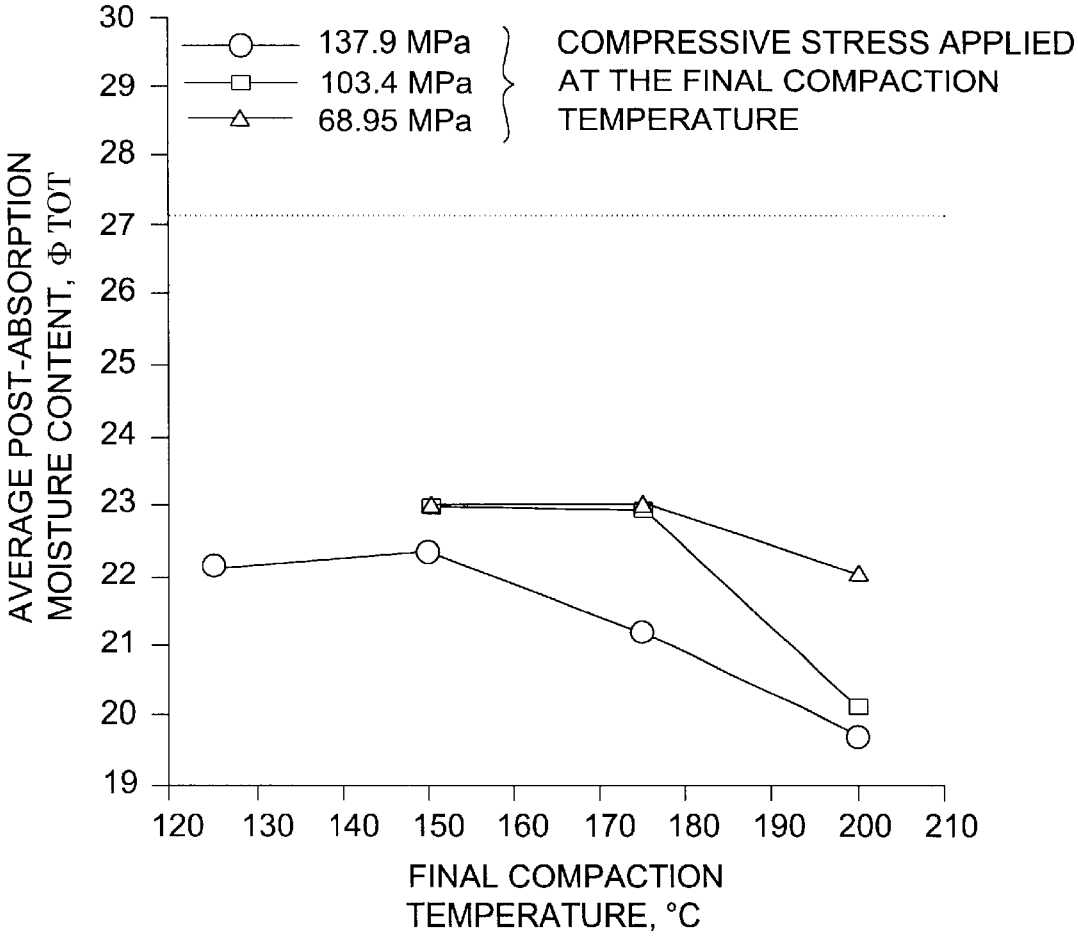
FIG. 4 is a graph showing the variation of average post-absorption moisture content ($\Phi_{tot}$) with the final compaction temperature and the compressive stress applied to the feed at the final compaction temperature for coal log compacts made in Example 2.

FIG. 4 is a graph showing the variation of average post-absorption moisture content ($\Phi_{tot}$) with the final compaction temperature and the compressive stress applied to the feed at the final compaction temperature. As shown in FIG. 4, as both the final compaction temperature and the compressive stress applied to the feed at the final compaction temperature were increased, $\Phi_{tot}$ decreased. It is believed that as the magnitude of the final compaction temperature and compressive stress were increased, more water was irreversibly removed from the substantially water-saturated coal particles.

It should be noted that some data from the strength study for coal logs made from Powder River Basin coal in Example 1 (See Table 2) overlaps data from the study of the variation of post-absorption tensile strength with final compaction temperature and compressive stress applied to the feed at the final compaction temperature (See FIG. 3), namely logs made at a final compaction temperature of about 200° C. and a compressive stress of about 138 MP (20,000 psi) gauge. The average post-absorption tensile strength of the four logs made under these conditions for the strength study in Table 2 was 0.67 MPa (97 psi) with a standard deviation of 0.09 MPa (13 psi) while the average post-absorption tensile strength of the three logs made under these conditions for the study shown in FIG. 3 was 1.03 MPa (150 psi) with a standard deviation of 0.02 MPa (2.6 psi). This increase in post-absorption tensile strength was due to fine-tuning of the compact forming process to minimize the circumferential cracking that was occurring, particularly when the logs were ejected from the mold. Circumferential cracks were lessened by cooling the log to a lower temperature prior to ejecting the log and by pushing the log out of the mold very slowly. Standard deviations for the average post-absorption tensile strengths reported in FIG. 3 ranged from a high of 0.10 MPa (14.68 psi) for the 150° C., 103 MPa (15,000 psi) gauge datum (average strength of three logs=0.59 MPa (85 psi)) to a low of 0.009 MPa (1.32 psi) for the 175° C., 137.9 MPa (20,000 psi) gauge datum (average strength of three logs=0.75 MPa (109 psi)).

EXAMPLE 3

Several steps were taken in order to further minimize detrimental circumferential cracking of the coal logs. The circumferential cracking that was observed in the logs made using the single piece, stainless steel cylindrical mold was thought to be due to a combination of two factors. First, it was thought that pushing the log out of the single piece cylindrical mold induced this type of cracking. Secondly, it was thought the tensile forces generated from wall friction during the cooling of the log in the mold cracked the log.

The first of these possible causes was eliminated by making logs in a split mold made of mild steel. The split mold comprised two rectangular blocks of steel, each having a semicircular groove extending the length of the block. The blocks were bolted together such that the grooves were aligned and formed a cylindrical mold of circular cross-section. After a coal log was formed in this mold, the log was ejected by loosening the bolts and separating the mold into its two halves.

Ten Logs were made from the Antelope coal using the split mold and the compressive stress and compaction temperature schedule shown in FIG. 2. The coal logs made in this Example had essentially the same dimensions as those made in Examples 1 and 2. The average post-absorption tensile strength of three of these logs was 1.24 MPa (180 psi) with a standard deviation of 0.06 MPa (9.3 psi). This post-absorption tensile strength was greater than any recorded for logs made with the single piece, stainless steel cylindrical mold, but due to the variability of log strength this may not be significant. The pre-absorption specific gravity was 1.268 (standard deviation=0.008%), the post-absorption specific gravity was 1.313 (standard deviation=0.004%), and the post-absorption moisture content, $\Phi_{tot}$, was 22.08% (standard deviation=0.13%). Circumferential cracking in the logs made using the split mold was much less prominent and degradation testing performance in the lab scale coal log pipeline was improved.

Table 5 below contains data regarding degradation testing of logs made using the split mold. Of the ten logs tested, all but one circulated for 60 minutes without failing. The average weight loss, for the 9 logs that circulated one hour without breaking, was 1.15% (standard deviation=0.4%)

after one hour of circulation. The average post-degradation tensile strength was 0.81 MPa (117 psi; average of 5 logs) with a standard deviation of 0.136 MPa (19.7 psi). There was a 35% loss of strength after one hour of circulation.

TABLE 5

| Log No. | Circulation Time (Center) | Number of Circulation Cycles | Weight Loss after 1 Hour Circulation (%) | Weight Loss at Termination of Test (%) | Post-Degradation Tensile Strength |
|---|---|---|---|---|---|
| 1 | 55 | 264 | — | 2.02 | — |
| 2 | 180 | 864 | 0.94 | 2.15 | — |
| 3 | 60 | 288 | 1.35 | 1.35 | — |
| 4 | 60 | 288 | 1.02 | 1.02 | — |
| 5 | 70 | 336 | 1.00 | 1.11 | — |
| 6 | 60 | 288 | 2.20 | 2.20 | 1.03 MPa 149 psi |
| 7 | 60 | 288 | 1.09 | 1.09 | 0.83 MPa 120 psi |
| 8 | 60 | 288 | 0.92 | 0.92 | 0.77 MPa 112 psi |
| 9 | 60 | 288 | 1.03 | 1.03 | 0.72 MPa 104 psi |
| 10 | 120 | 576 | 0.82 | 1.22 | 0.68 MPa 99 psi |

To further reduce circumferential cracks and to produce stronger more durable logs, a chrome-plated split mold was used to make coal logs. The chrome-plated split mold was identical to the mild steel split mold except that the wall of the semicircular grooves in the rectangular steel blocks were chrome-plated to further reduce friction and adhesion between the forming log and the mold.

Six coal logs were made from the Antelope coal using the chrome-plated split mold and the compressive stress and temperature schedule shown in FIG. 2. The average post-absorption tensile strength for these logs was 1.31 MPa (190 psi) with a standard deviation of 0.26 MPa (37 psi). The average post-absorption moisture content, $\Phi_{tot}$, was 18.4% with a standard deviation of 0.64%. This was lower than the 22% post-absorption moisture content that was typical of similar logs made in the mild steel split mold. Apparently, the decrease in the coal's saturation moisture content that results from the HWF process is enhanced when the chrome plated mold is used. It is believed that with less wall friction, more water may have been squeezed irreversibly from the log when compressive stress was applied during log formation.

Table 6 below contains data from degradation testing of three of these logs in the lab scale coal log pipeline. Each of the three logs was circulated for 60 minutes without failing. The average post-degradation tensile strength was 1.30 MPa (189 psi) with a standard deviation of 0.14 MPa (21 psi). The loss of strength after one hour of circulation of these logs was negligible. The average weight loss after one hour of circulation was 0.42% (standard deviation=0.07%).

TABLE 6

| Log No. | Circulation Time (minutes) | Number of Circulation Cycles | Weight Loss after 1 Hour Circulation (%) | Post-Degradation Tensile Strength |
|---|---|---|---|---|
| 1 | 60 | 288 | 0.43 | 1.52 MPa 220 psi |

TABLE 6-continued

| Log No. | Circulation Time (minutes) | Number of Circulation Cycles | Weight Loss after 1 Hour Circulation (%) | Post-Degradation Tensile Strength |
|---|---|---|---|---|
| 2 | 60 | 288 | 0.33 | 1.18 MPa 172 psi |
| 3 | 60 | 288 | 0.50 | 1.22 MPa 177 psi |

Three logs were also made from the Mapco coal using the chrome-plated split mold and the compressive stress and temperature schedule shown in FIG. 2.

Table 7 below contains data from degradation testing of these three logs in the lab scale coal log pipeline. All three of these logs were circulated in the test pipeline for 60 minutes without failing. The average post-degradation tensile strength was 0.23 MPa (33.9 psi) with a standard deviation of 0.034 MPa (5.3 psi). The average weight loss after one hour of circulation was 12.8% with a standard deviation of 4.8%. The average post-absorption moisture content, $\Phi_{tot}$, was 5.0% with a standard deviation of 0.21%. This is greater than the 1.7% saturation moisture content for the Mapco feed coal. Overall, performance of coal logs made from the high rank Mapco feed coal was much worse than for the low rank Antelope coal and probably unacceptable for long distance pipeline transportation.

TABLE 7

| Log No. | Circulation Time (minutes) | Number of Circulation Cycles | Weight Loss after 1 Hour Circulation (%) | Post-Degradation Tensile Strength |
|---|---|---|---|---|
| 1 | 60 | 270 | 12.9 | 0.28 MPa 4.12 psi |

TABLE 7-continued

| Log No. | Circulation Time (minutes) | Number of Circulation Cycles | Weight Loss after 1 Hour Circulation (%) | Post-Degradation Tensile Strength |
|---|---|---|---|---|
| 2 | 60 | 263 | 6.88 | 0.22 MPa 31.6 psi |
| 3 | 60 | 267 | 18.6 | 0.20 MPa 28.9 psi |

EXAMPLE 4

Four larger diameter coal logs were produced by the HWF process for testing in a commercial scale pipeline to develop correlation between log performance in the laboratory and commercial log performance. The coal logs produced in this Example were made from Rochelle coal, a subbituminous coal that is very similar to the Powder River Basin and Antelope coals used in the preceding Examples. The logs had a diameter of about 13.5 cm.

Rochelle coal was first substantially water-saturated, ball-milled and sieved as described in Example 1. The logs were then fabricated using a chrome plated, mild steel split mold, a maximum compressive stress of about 69 MPa (10,000 psi) gauge and a final compaction temperature of about 170° C. as measured at the wall of the mold. The final compaction temperature and maximum compressive stress were maintained for about 30 minutes. Under these conditions, the outer region of the coal log was essentially heated to the final compaction temperature, but the coal in the center of the mold was somewhat cooler.

Several properties of one of the logs were measured to characterize the logs. One day after the logs were made, a log was subjected to water absorption testing by immersing the logs in water at a static pressure of 3.45 MPa (500 psi) gauge water for 24 hours. The pre and post water absorption specific gravity of the log was 1.19 and 1.26, respectively. The post-absorption tensile strength of the log was 0.40 MPa (58.4 psi) and the post-absorption moisture content, $\Phi_{tot}$, of the log was 28.8%. The log was less dense, weaker, and had a greater post-absorption moisture content than laboratory scale logs made at the same maximum compressive stress and final compaction temperature. The log also had visible circumferential surface cracks.

The inventors believe that the primary reason that the properties of the larger diameter log differed from the properties of the laboratory scale logs was due to the larger temperature gradient in the forming compact. If the coal in the mold was heated more uniformly, it is believed that the properties and performance of the logs would be improved.

The remaining three logs were then subjected to degradation testing by circulating them in a long commercial steel pipeline near Conway Kansas, USA. The pipeline belongs to the Mid-America Pipeline Company and was constructed for conveying water for oil recovery and fire fighting. The pipeline had a nominal diameter of about 15.25 cm and was about 7.4 km (4.6 mile) long. The pump system for the pipeline was capable of pumping water through the pipeline with a cross-sectional mean velocity of about 1.8 m/s (6 fps). This velocity was approximately two thirds of the theoretical macro lift-off velocity for the larger diameter logs. Thus, the logs dragged along the bottom of the pipeline during the test. The weight losses for the three logs after one pass through the pipeline were 1.06%, 0.27% and 0.51%, respectively. After circulation, the circumferential cracks in the logs were more prominent, but none of the logs broke. No further circulation of the logs was attempted, due to the limited availability of the pipeline. This Example illustrates that coal compacts formed in accordance with the present invention are suitable or commercial pipeline transportation.

In view of the above, it will be seen that the several objects of the invention are achieved. As various changes could be made in the above-described invention without departing from the scope of the invention, it is intended that all matter contained in the above description be interpreted as illustrative and not in a limiting sense.

What is claimed is:

1. A process for making compacts from coal particles, the process comprising:

heating a particulate feed comprising substantially water-saturated coal particles to a temperature greater than about 100° C., said particulate feed being heated at a pressure sufficient to prevent water in said feed from boiling;

compacting said heated particulate feed in a mold by applying a compressive stress to said heated feed to form said compact; and cooling the formed compact, said compact being cooled at a pressure sufficient to prevent water in said cooling compact from boiling.

2. A process as set forth in claim 1 wherein said mold is cylindrical and has a circular cross section such that said compact is formed in the shape of a cylinder having a circular cross section.

3. A process as set forth in claim 2 wherein said compressive stress applied to said heated feed is at least about 34.5 MPa (5,000 psi) gauge.

4. A process as set forth in claim 2 wherein said compressive stress applied to said heated particulate feed is maintained for a load holding period, the temperature to which the particulate feed is heated, the magnitude of said compressive stress and said load holding period being controlled such that the compact produced has a tensile strength of at least about $3.4\times10^5$ Pa (50 psi) after being formed and cooled to about 27° C.

5. A process as set forth in claim 2 wherein said formed compact is ejected from said mold prior to said cooling, said compact being ejected into a hyperbaric environment in which the ambient pressure is sufficient to prevent water in said cooling compact from boiling.

6. A process as set forth in claim 2 wherein said formed compact is cooled to an ejection temperature in said mold while maintaining sufficient compressive stress on said compact to prevent water in said compact from boiling, said ejection temperature being sufficiently low such that said compressive stress can be removed from said compact after cooling without inducing water in said compact to boil.

7. A process as set forth in claim 1 wherein said particulate feed comprising substantially water-saturated coal particles is produced by contacting coal particles with liquid water or saturated steam.

8. A process as set forth in claim 1 wherein said particulate feed is heated to a temperature of at least about 125° C.

9. A process as set forth in claim 8 wherein said particulate feed is heated to a temperature of at least about 150° C.

10. A process as set forth in claim 1 wherein said coal particles which comprise said particulate feed pass through a sieve having 2.36 mm openings.

11. A process for making compacts from coal particles, the process comprising:

preheating a particulate feed comprising substantially water-saturated coal particles, said particulate feed being preheated at an ambient pressure of about 1 atmosphere to a temperature less than about 100° C. such that water in said feed does not boil;

compacting said preheated particulate feed by applying a compressive stress to said preheated particulate feed in a mold, said compressive stress being sufficient to prevent water in said compacted feed from boiling when said compacted feed is subsequently heated to a final compaction temperature;

heating said compacted particulate feed in said mold to said final compaction temperature while maintaining said compressive stress to form said compact, said final compaction temperature being greater than about 100° C.;

cooling the formed compact to an ejection temperature in said mold while maintaining sufficient compressive stress on said compact to prevent water in said compact from boiling, said ejection temperature being sufficiently low such that said compressive stress can be removed from said compact after cooling without inducing water in said compact to boil; and ejecting said cooled compact from said mold.

12. A process as set forth in claim 11 wherein said mold is cylindrical and has a circular cross section such that said compact is formed in the shape of a cylinder having a circular cross section.

13. A process as set forth in claim 12 wherein said compressive stress applied to said compacted particulate feed is increased after said compacted particulate feed is heated to said final compaction temperature.

14. A process as set forth in claim 13 wherein said compressive stress applied to said compacted particulate feed is increased to at least about 34.5 MPa (5,000 psi) gauge after said compacted particulate feed is heated to said final compaction temperature.

15. A process as set forth in claim 12 wherein said compressive stress applied to said particulate feed heated to said final compaction temperature is maintained for a load holding period, said final compaction temperature, the magnitude of said compressive stress and said load holding period being controlled such that the compact produced has a tensile strength of at least about $3.4\times10^5$ Pa (50 psi) after being formed and cooled to about 27° C.

16. A process as set forth in claim 11 wherein said particulate feed is preheated at an ambient pressure of about 1 atmosphere to a temperature of at least about 90° C.

17. A process as set forth in claim 11 wherein said particulate feed comprising substantially water-saturated coal particles is produced by contacting coal particles with liquid water or saturated steam.

18. A process as set forth in claim 11 wherein said final compaction temperature is at least about 125° C.

19. A process as set forth in claim 18 wherein said final compaction temperature is at least about 150° C.

20. A process as set forth in claim 11 wherein said coal particles which comprise said particulate feed pass through a sieve having 2.36 mm openings.

* * * * *